US012268259B1

(12) United States Patent
Ames et al.

(10) Patent No.: US 12,268,259 B1
(45) Date of Patent: Apr. 8, 2025

(54) RESTRAINING BANDS FOR INFANT AND CHILDREN CLOTHING

(71) Applicants: Raleigh Ames, Columbus, MT (US); Heidi Ames, Columbus, MT (US)

(72) Inventors: Raleigh Ames, Columbus, MT (US); Heidi Ames, Columbus, MT (US)

( * ) Notice: Subject to any disclaimer, the term of this patent is extended or adjusted under 35 U.S.C. 154(b) by 91 days.

(21) Appl. No.: 18/347,652

(22) Filed: Jul. 6, 2023

(51) Int. Cl.

| | |
|---|---|
| ***A41F 19/00*** | (2006.01) |
| ***A41D 20/00*** | (2006.01) |
| ***A41F 9/02*** | (2006.01) |
| ***A41F 13/00*** | (2006.01) |

(52) U.S. Cl.
CPC ..... *A41F 19/00* (2013.01); *A41D 20/00* (2013.01); *A41F 9/02* (2013.01); *A41F 9/025* (2013.01); *A41F 13/00* (2013.01)

(58) Field of Classification Search
CPC .. A41F 19/00; A41F 9/02; A41F 9/025; A41F 13/00; A41D 20/00
See application file for complete search history.

(56) References Cited

U.S. PATENT DOCUMENTS 846,914 A * 3/1907 Vries ..... A41F 9/025 2/315
1,076,031 A * 10/1913 Gamble ..... A41D 1/089 24/570
1,174,976 A * 3/1916 Gaines ..... A41D 1/21 2/221
2,019,248 A * 10/1935 Blumgardt ..... A41D 3/02 2/93
2,107,046 A * 2/1938 Rohatyn ..... A41F 9/025 2/221
2,563,161 A * 8/1951 Dixon ..... A41B 13/005 D2/713
2,588,542 A * 3/1952 Kunz ..... A41B 13/005 2/80
2,751,599 A * 6/1956 Peterson ..... A41F 9/02 2/237
3,086,529 A * 4/1963 Munz ..... A61B 17/1322 63/3
3,555,569 A * 1/1971 Jones ..... A41F 9/02 2/400
3,732,576 A * 5/1973 Guthier ..... A41B 9/14 2/221
4,384,583 A * 5/1983 Speelman ..... A61B 17/1322 2/338
4,521,922 A * 6/1985 Mitchell ..... A41D 20/005 2/DIG. 11

(Continued)

*Primary Examiner* — Khaled Annis
(74) *Attorney, Agent, or Firm* — Miller IP Law; Devin Miller

(57) ABSTRACT

Described herein are examples of restraining bands for footed portions of children's clothing, such as footed pajamas, the restraining bands having a rectangular geometry with a horizontal length and a vertical height, wherein the horizontal length of the restraining band is greater than the vertical height of the restraining band. The restraining band includes a front side and a back side. The restraining band further includes a body section prepared from an elastic material. The body section further includes a front side fastening section, with a horizontal length greater than the vertical height of the front side fastening section. Additionally, the restraining band includes a sheath configured to cover the body section.

20 Claims, 3 Drawing Sheets

(56) References Cited

U.S. PATENT DOCUMENTS 4,825,475 A * 5/1989 Smart ..... A41F 17/04 2/920
4,991,234 A * 2/1991 Greenberg ..... A61F 5/028 2/920
5,377,360 A * 1/1995 Fleitman ..... A41D 20/00 2/DIG. 11
5,456,274 A * 10/1995 Selbee ..... A45D 8/36 132/275
5,478,306 A * 12/1995 Stoner ..... A61F 5/0118 602/20
5,598,585 A * 2/1997 Stroup ..... A41D 20/00 132/273
6,000,062 A * 12/1999 Trakh ..... A42B 3/00 2/200.1
6,023,786 A * 2/2000 Burnett ..... A44C 5/00 2/21
6,158,057 A * 12/2000 Neumann ..... A41F 17/02 2/312
6,339,847 B1 * 1/2002 Hanks ..... A41B 13/005 2/269
6,393,619 B1 * 5/2002 Bardes ..... A43B 3/30 2/232
6,775,846 B1 * 8/2004 LaFauci ..... A41F 19/005 2/125
2006/0021630 A1 * 2/2006 Lafauci ..... A45D 8/36 132/273
2006/0206991 A1 * 9/2006 Barnes ..... A41F 19/00 2/311
2007/0084480 A1 * 4/2007 Chudzik ..... A45D 8/36 132/273
2010/0206323 A1 * 8/2010 August ..... A41D 20/00 132/273
2010/0235967 A1 * 9/2010 Janakus ..... A41F 9/025 2/311
2013/0145518 A1 * 6/2013 Decet ..... A41D 13/0058 2/171.2
2013/0227765 A1 * 9/2013 Bailey ..... A41F 1/06 2/311
2014/0208485 A1 * 7/2014 Kjar ..... A41D 1/21 2/312
2018/0279706 A1 * 10/2018 Cassell ..... A41F 13/00
2021/0076761 A1 * 3/2021 Mamedova ..... A41D 20/00
2021/0386250 A1 * 12/2021 DiMaria ..... A47K 10/025

* cited by examiner

RESTRAINING BANDS FOR INFANT AND CHILDREN CLOTHING

BACKGROUND

Infant and children's clothing comes in myriad shapes, styles, colors, cloths, textures, and patterns. The variations in infant and children's clothing are only limited by the imagination of the designer. However, typically for infants and small children, and particularly for nighttime clothing, or pajamas, the clothing can be one-piece or two-piece sets, where the bottom of the article of clothing (or bottom of the bottom half) often includes footed bottoms.

BRIEF DESCRIPTION OF THE DRAWINGS

The present description will be understood more fully when viewed in conjunction with the accompanying drawings of various examples of restraining bands for infant and children clothing. The description is not meant to limit the restraining bands for infant and children clothing to the specific examples. Rather, the specific examples depicted and described are provided for explanation and understanding of restraining bands for infant and children clothing. Throughout the description the drawings may be referred to as drawings, figures, and/or FIGS.

DETAILED DESCRIPTION

Figure 1:
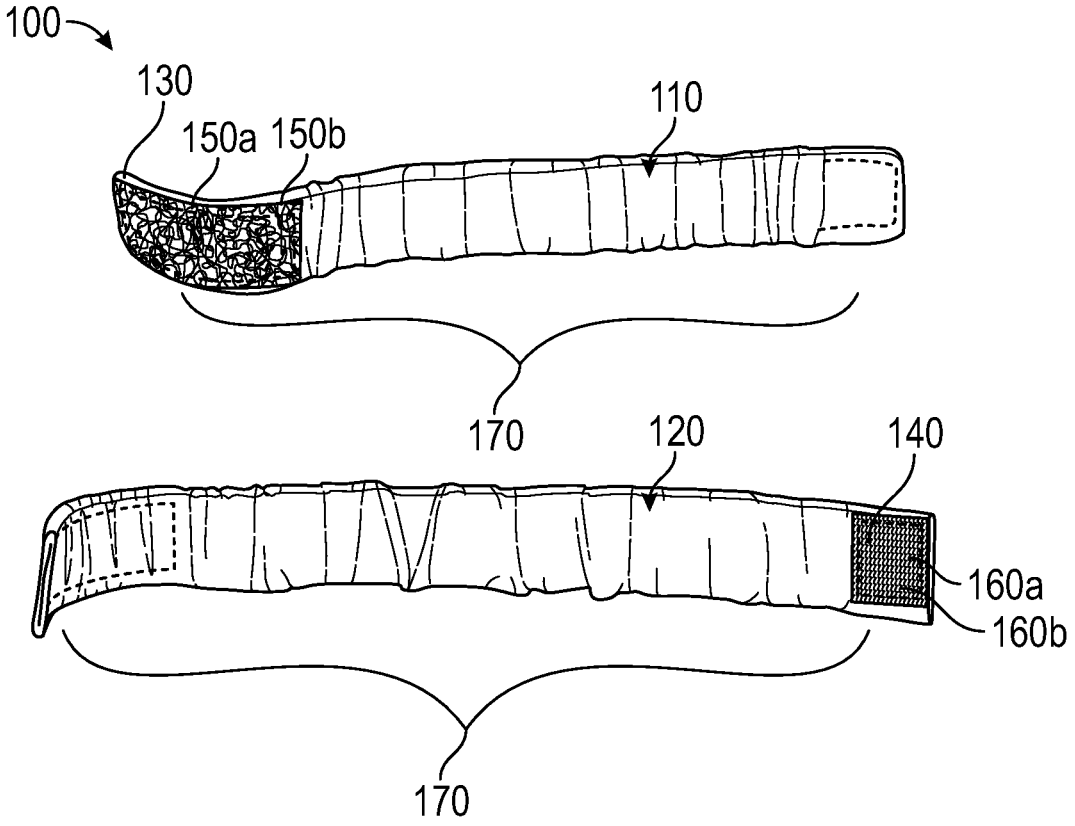
FIG. 1 illustrates a front side and back side view of a restraining band for infant and children's clothing, according to an embodiment.

Restraining bands for infant and children's clothing as disclosed herein will become better understood through a review of the following detailed description in conjunction with the figures. The detailed description and figures provide merely examples of the various embodiments of restraining bands for infant and children's clothing. Many variations are contemplated for different applications and design considerations; however, for the sake of brevity and clarity, all the contemplated variations may not be individually described in the following detailed description. Those skilled in the art will understand how the disclosed examples may be varied, modified, and altered and not depart in substance from the scope of the examples described herein.

Infant and children's clothing requires constant attention because the user of the clothing is generally unable to communicate their needs or comfort level. Additionally, because of the rapid growth of infants and young children ("the child") the clothing will not outlast the period in which the child will be able to wear the clothing, i.e., the child will outgrow the article of clothing before the article of clothing has worn out and/or is ready to be discarded.

Conventional infant and children's clothing often comes in sizes ranging from 1 month to toddler, with intermediate sizes ranging from 1 month, 2 months, 3 months, 3-6 months, 6-9 months, 6-12 months, 1-2 years, toddler, and variations thereof. These variations are employed because of the constant size change of infants and young children. This generally results in articles of clothing being worn by infants and small children only once or twice before they are discarded.

Additionally, because no child is exactly the same size and shape at specific times in their development, different articles of clothing fit the child in different ways. This can lead to issues, particularly with footed one- or two-piece articles of clothing, where the child's foot will not remain in the footed portion of the article of clothing causing discomfort and difficulty in locomotion for the child.

Implementations of restraining bands for infant and children's clothing may address some or all of the problems described above. Restraining bands for infant and children's clothing can allow clothing to fit the child more securely and allow for articles of clothing to be used longer for a specific child. The restraining band can be adapted to encircle the child's ankle thereby separating the leg portion of the article of clothing from the footed bottoms of the article of clothing. This can allow for adjustment of the length of the leg portion and securing of the footed bottoms.

Embodiments can be prepared that are permanently secured to the article of clothing and/or detachable from the article of clothing. Additionally, embodiment can be adapted to match the article of clothing either by attaching a matching fabric to an existing restraining band and/or preparing the restraining band from the same fabric as the article of clothing.

Embodiments can include securing elements to engage the restraining band selected from hook and loop fasteners, buttons, clips, hook and eye fasters, snaps, and variations thereof.

FIG. 1 illustrates a front and a back view of a restraining band for infant and children's clothing, according to an embodiment. The restraining band 100 includes a front side 110 and a back side 120. The front side 110 of the restraining band 100 can include a front side fastening section 130 that can include loops 150*a*, 150*b*, and the back side 120 of the straining band 100 can include a back side fastening section 140 that can include hooks 160*a*, 160*b*. Alternate embodiments can include the loops 150*a*, 150*b* in the back side fastening section 140, and hooks 160*a*, 160*b* in the front side fastening section 130.

The restraining band 100 further includes a body section 170 that extends from the front side fastening section 130 to the back side fastening section 140. The body section 170 is generally rectangular in shape but can have alternate shapes and styles depending on the needs of the article of clothing or fashion design.

Figure 2:
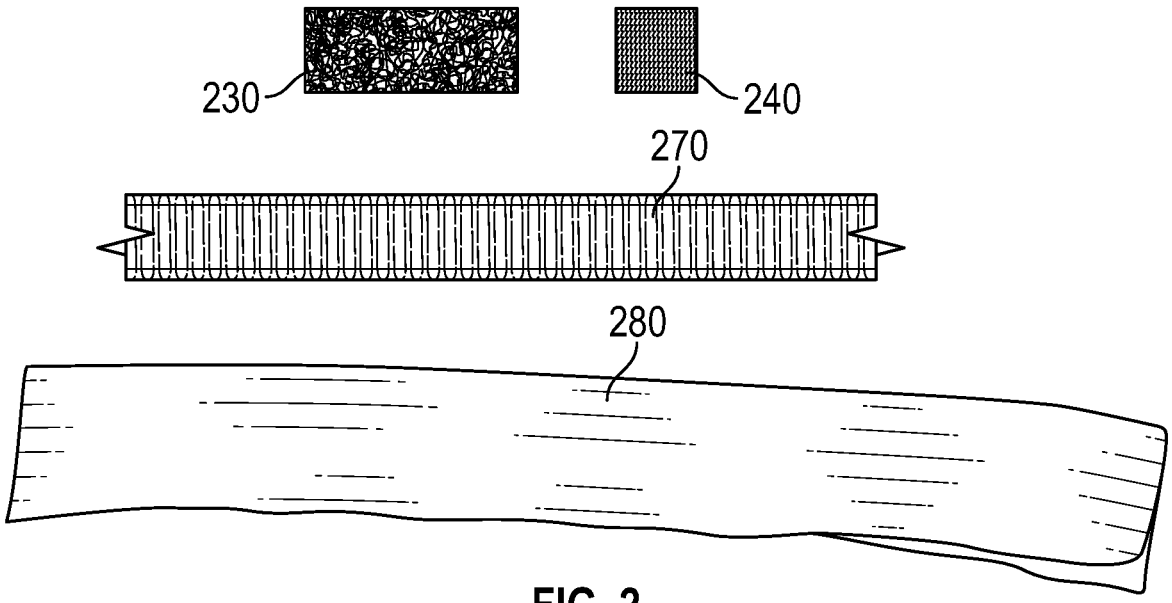
FIG. 2 illustrates an exploded restraining band for infant and children's clothing, according to an embodiment.

FIG. 2 illustrates an exploded restraining band for infant and children's clothing, according to an embodiment. Depicted in the exploded view are the front side fastening section 230, the back side fastening section 240, and the body section 270, according to an embodiment. The body section 270 can be prepared from fabric material generally used for articles of clothing, or it can be prepared from an elastic material to assist with the restraining of the ankle of the child. Embodiments include elastic materials selected from 2-way or 4 way stretch materials (materials and/or fabrics that stretch and then return to their original size in two directions or one direction), including stretch jersey knit, cotton jersey knit, stretch cotton poplin, stretch cotton shirting, stretch cotton sateen, stretch cotton jacquard, stretch viscose jacquard, stretch silk satin, stretch silk crepe, stretch silk lining, stretch satin chiffon, stretch wool, stretch wool crepe, stretch velvet, stretch lace, stretch tulle, elastane, rubbers, plastics, neoprene, polyesters, elastomers, compression fabrics, warp knitting, and mixtures thereof.

The front side fastening section 230 and back side fastening section 240 can be attached to the distal ends of the body section 270 or overlap a portion of the distal ends of the body section 270.

Embodiments include front side fastening sections 230 are generally rectangular with a horizontal length greater than their vertical height. This allows the restraining band 200 to vary in horizontal length depending on the placement of the back side fastening section 240 on the front side fastening section 230 when the restraining band 200 is engaged. The horizontal length of the front side fastening section 230 can be between 0.5 and 10 inches in horizontal length, between 1 and 5 inches in horizontal length, between 1.5 and 3 inches in horizontal length, and 2 inches in horizontal length. The vertical height of the front side fastening section 230 can be between 0.25 and 3 inches, between 0.50 and 2 inches, between 0.75 and 1 inch, and 0.75 inches. Additional variations will be readily understood by persons skilled in the art.

Embodiments include back side fastening sections 240 that are generally square with a relatively equal horizontal length and vertical height. The horizontal length of the back side fastening section 240 can be between 0.25 and 3 inches, between 0.50 and 2 inches, between 0.75 and 1 inch, and 0.75 inches. The vertical height of the back side fastening section 240 can be between 0.25 and 3 inches, between 0.50 and 2 inches, between 0.75 and 1 inch, and 0.75 inches. Additional variations in shape, length and height will be readily understood by persons skilled in the art.

Embodiments of the body section 270 are generally rectangular with a horizontal length greater than the vertical height. Embodiments include a body section 270 between 15 and 3 inches, between 10 and 5 inches, between 8 and 6 inches, and 7 inches in horizontal length. Embodiments include a body section 270 between 0.25 and 3 inches, between 0.5 and 2 inches, between 0.75 and 1 inch, and 1 inch in vertical height. Additional variations in shape, length and height will be readily understood by persons skilled in the art.

The greater horizontal length of the restraining band 200 than its vertical height allows it to easily be wrapped around the ankle of child thereby securing the footed portion of the article of clothing in place providing comfort to the foot and reduced bunching of material. The reduction of bunching of material in the footed portion of the article of clothing adds comfort and safety for the child. The safety feature is particularly evident in toddlers and small children that have begun to walk and could be tripped by bunching of material in the footed portion of the article of clothing.

An additional benefit of the restraining band 200 is that additional material can be bunched above the footed portion of the article of clothing without interfering with the comfort or locomotion of the child. This allows for the article of clothing to have an extended lifespan because the child can grow into the clothing without suffering from discomfort and walking issues related to bunching of material in the footed portion of the article of clothing.

Embodiments of the restraining band 200 can have a sheath 280 that is configured to surround the body section 270 of the restraining band 200. The sheath 280 can be prepared from any fabric material suitable for the infant and children's clothing. Embodiments of the sheath 280 can be chosen to mimic and/or match the article of clothing. This allows for a continuity of the article of clothing in which the restraining band 200 does not trigger the eye of an observer as an added element. Additionally, for children that have sensory issues that may cause them to reject the restraining band 200, an inability to notice its addition the article of clothing because of the matching materials can improve the experience for the child or infant and lead to greater compliance (wearing) with the restraining band 200.

Embodiments of the sheath 280 can be sewn in place around the body section 270, attached by a separate hook and loop fastener, buttons, clips, or other fastening systems. It is not necessary for the sheath 280 to be prepared from an elastic material, but if it is not prepared from an elastic material it should have a horizontal length that is greater than the body section 270 to allow for stretching of the body section 270 along it horizontal axis.

Embodiments include a device including a restraining band having a rectangular geometry with a horizontal length and a vertical height, wherein the horizontal length of the restraining band is greater than the vertical height of the restraining band; and the restraining band includes a front side; and a back side. The restraining band further includes a body section, wherein the body section is prepared from an elastic material. The body section further includes a front side fastening section, wherein the front side fastening section has a horizontal length greater than the vertical height of the front side fastening section. The sheath is configured to cover the body section, and the sheath is prepared from a fabric material.

Embodiments include the front side fastening section and the back side fastening section including fastening elements selected from hook and loop fasteners, hook and eye fasteners, buttons, clips, tabs, and combinations thereof.

Embodiments include a sheath configured to be larger than the body portion of the restraining band to allow the elastic material to stretch within the sheath.

Embodiments include a restraining band configured to be joined to an ankle portion of an article of clothing comprising a footed portion.

Embodiments include a restraining band is configured to be secured around an ankle portion of an article of clothing comprising a footed portion, wherein the restraining band is not permanently attached to the article of clothing.

Embodiments include the elastic material selected from the group consisting of stretch jersey knit, cotton jersey knit, stretch cotton poplin, stretch cotton shirting, stretch cotton sateen, stretch cotton jacquard, stretch viscose jacquard, stretch silk satin, stretch silk crepe, stretch silk lining, stretch satin chiffon, stretch wool, stretch wool crepe, stretch velvet, stretch lace, stretch tulle, elastane, rubbers, plastics, neoprene, polyesters, elastomers, compression fabrics, warp knitting, and mixtures thereof.

Embodiments may further include a sheath prepared from a fabric material that matches the article of clothing, and the design and color of the sheath matches the article of clothing.

Embodiments include a restraining band back side fastening section with a square or rectangular geometry, the front side fastening section with a rectangular geometry, and wherein the front side fastening section has a horizontal length at least three times greater than the horizontal length of the back side fastening section. Alternate embodiments can have a front side fastening section two, four, five, six, and variations thereof longer than the back side fastening section.

Figure 3:
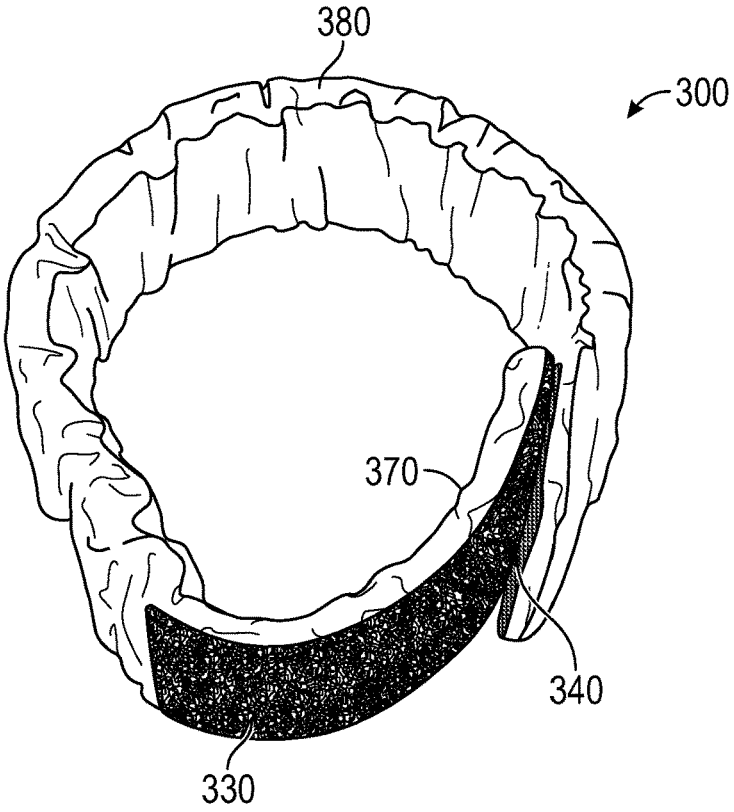
FIG. 3 illustrates an engaged restraining band for infant and children's clothing, according to an embodiment.

FIG. 3 illustrates an engaged restraining band for infant and children's clothing, according to an embodiment. As depicted in FIG. 3 the restraining band 300 includes a front side fastening section 330, a back side fastening section 340, a sheath 380, and a body portion (not shown). The restraining band 300 as illustrated in FIG. 3 is in the engaged configuration whereby the front side fastening section 330 is engaged with the back side fastening section 340 forming an enclosed circle. The engaged configuration is configured to surround the ankle (or possibly the wrists) of an infant or child. The sheath 380 is partially crimped because the sheath 380 is longer than the body portion thereby allowing for stretching of the body portion along its horizontal axis. The ability of the body portion to stretch along its horizontal axis allows for ease of engaging the front side fastening section 330 and the back side fastening section 340 and comfortably securing the restraining band 300 around the ankle (or wrist) of the child. The engaged restraining band 300 as depicted in FIG. 3 is in an elongated or large configuration whereby the back side fastening section 340 is closer to the distal end of the front side fastening section 330. This configuration provides a larger or larger circumference for the engaged restraining band 300.

Figure 4:
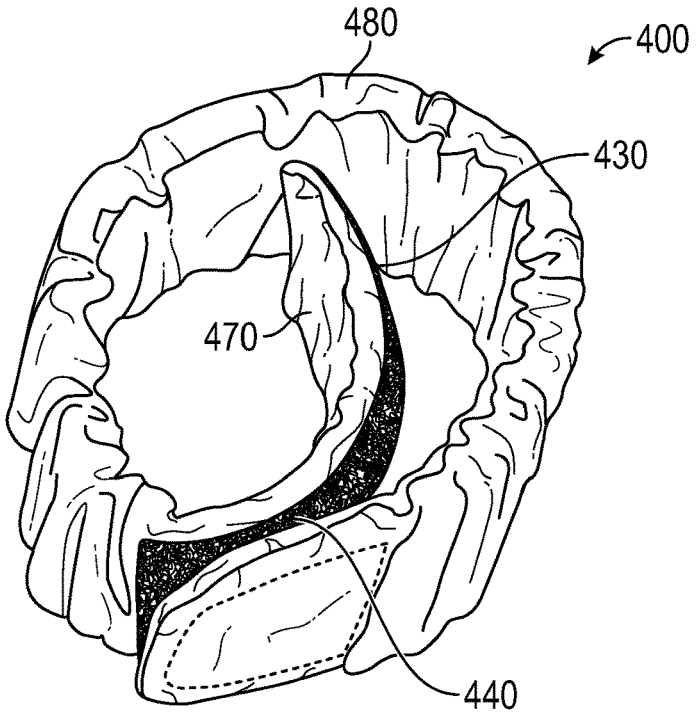
FIG. 4 illustrates an alternate engagement for a restraining band for infant and children's clothing, according to an embodiment.

FIG. 4 illustrates an alternate engagement for a restraining band for infant and children's clothing, according to an embodiment. As depicted in FIG. 4 the restraining band 300 includes a front side fastening section 430, a back side fastening section 440, a sheath 480, and a body portion (not shown). The restraining band 400 as illustrated in FIG. 4 is in the engaged configuration whereby the front side fastening section 430 is engaged with the back side fastening section 440 forming an enclosed circle. The engaged restraining band 400 as depicted in FIG. 4 is in a truncated or small configuration whereby the back side fastening section 440 is attached proximate to the body portion away from the distal end of the front side fastening section 430. This configuration provides a small or smaller circumference for the engaged restraining band 400. A smaller circumference of the restraining band 400 will allow for tighter and/or more secure restraining bands 400 for infants and children with smaller ankles (or wrists). As illustrated in FIG. 4, the front side fastening section 430 has been affixed to the back of the body portion 470 thereby providing extra comfort on the inside of the restraining band 400. Embodiments can include front side fastening section 430 (and back side fastening section 440) that are attached to the distal ends of the body portions 470.

Figure 5:
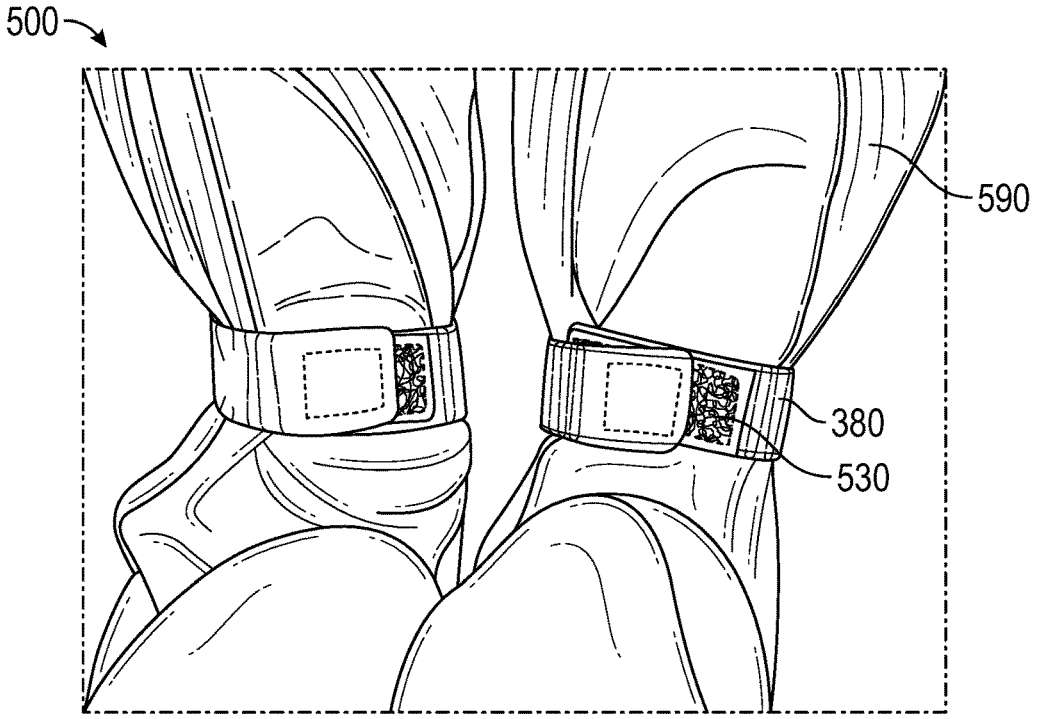
FIG. 5 illustrates a user wearing the restraining bands for infant and children's clothing, according to an embodiment.

FIG. 5 illustrates a user wearing the restraining bands for infant and children's clothing, according to an embodiment. As depicted in FIG. 5, two sets of restraining bands 500 are attached to a child's ankles on the outside of an article of clothing with footed bottoms. The restraining bands 500 are in the engaged position whereby the back side fastening section 540 is engaged with the front side fastening section 530. In the engaged configuration depicted in FIG. 5 only a portion of the front side fastening section 530 not covered by the back side fastening section 540 is visible. Additionally, in the embodiment illustrated in FIG. 5 the sheath 580 matches the article of clothing 590 causing the restraining bands 500 to blend and/or camouflage into the article of clothing 590. The restraining bands 500 depicted in FIG. 5 are in an engagement providing a generally middle level of horizontal length. The back side fastening sections 540 are not positioned completely over the front side fastening sections 530 (smallest configuration) and are not positioned at the distal end of the front side fastening sections 530 (largest configuration). The versatility of the restraining bands 500 allows for adaptability of the size of the restraining bands 500 and comfort for the infant/child.

Embodiments include a restraining band wherein the body portion of the restraining band is configured to match the fabric of the article of clothing; and match the design and color of the article of clothing. Embodiments further include a restraining band wherein the front side fastening section and the back side fastening section include fastening elements selected from hook and loop fasteners, hook and eye fasteners, buttons, clips, tabs, and combinations thereof.

Embodiments further include a sheath configured to surround the body portion of the restraining band, and provide additional comfort to a user. To provide additional comfort the sheath can be prepared from rubber, padding, or cushioning elements. In an alternate embodiment, the sheath can be configured to surround the body portion of the restraining band, and the sheath can be configured to not match the color or design of the article of clothing. This can provide added style elements to an article of clothing and/or assist the caregiver with identifying the restraining bands and ensuring they are securely attached and engaged.

Figure 6:
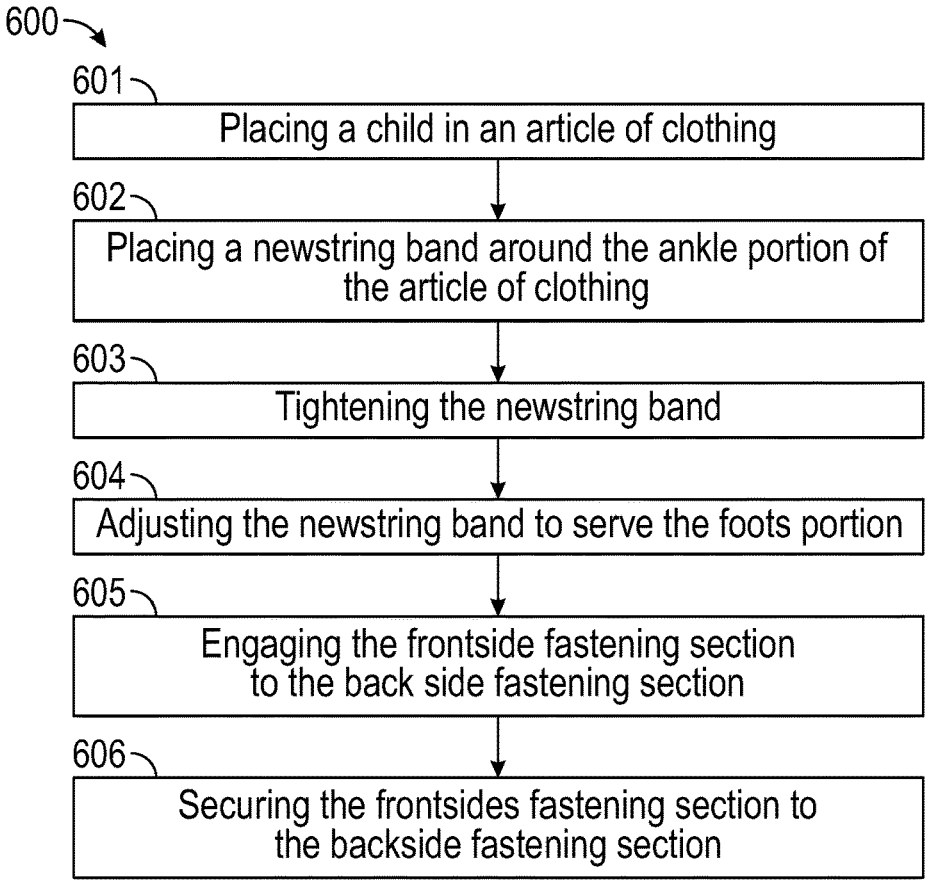
FIG. 6 illustrates a flow chart for a method of securing a restraining band to an article of clothing worn by a child or infant, according to an embodiment.

FIG. 6 illustrates a flow chart for a method of securing a restraining band to an article of clothing worn by a child or infant (user), according to an embodiment. Embodiments include a method, including step 601 placing a child in an article of clothing, wherein the article of clothing comprises a footed portion below an ankle portion. Step 602 placing a restraining band around the ankle portion of the article of clothing. Step 603 tightening the restraining band around the ankle of the child until the restraining band is both secure and comfortable for the child. Step 604 adjusting the restraining band to ensure the footed portion of the article of clothing is secure on the child. Step 605 engaging a front side fastening section to a back side fastening section of the restraining band. The method further including the restraining band configured in a rectangular geometry, wherein the front side fastening section is located on a side of a body section of the restraining band opposite the back side fastening section; the front side fastening section and the back side fastening section comprise hook and loop fastening elements; and the horizontal length of the restraining band is configured to fit the ankle of a child. And step 606 securing the front side fastening section and the back side fastening section via engagement of the hook an loop fastening elements.

Embodiments further include the back side fastening section is engaged at a distal end of the front side fastening section in an extended configuration.

Embodiments include the back side fastening section is engaged at an end of the front side fastening section proximate to the body portion in a truncated configuration.

Embodiments include restraining bands placed at wrist portions of an article of clothing.

Embodiments further include a sheath is configured to surround the body portion of the restraining band wherein the sheath is further configured to match the fabric of the article of clothing, and provide added comfort to a user via rubber, padding or cushioning.

Embodiments include a back side fastening section with a square geometry; a front side fastening section with a rectangular geometry; and wherein the front side fastening section has a horizontal length at least five times greater than the horizontal length of the back side fastening section.

Embodiments further include a restraining band configured to be attached to the article of clothing via loops, clips, buttons, or thread.

A feature illustrated in one of the figures may be the same as or similar to a feature illustrated in another of the figures. Similarly, a feature described in connection with one of the figures may be the same as or similar to a feature described in connection with another of the figures. The same or similar features may be noted by the same or similar reference characters unless expressly described otherwise. Additionally, the description of a particular figure may refer to a feature not shown in the particular figure. The feature may be illustrated in and/or further described in connection with another figure.

Elements of processes (i.e. methods) described herein may be executed in one or more ways such as by a human, by a processing device, by mechanisms operating automatically or under human control, and so forth. Additionally, although various elements of a process may be depicted in the figures in a particular order, the elements of the process may be performed in one or more different orders without departing from the substance and spirit of the disclosure herein.

The foregoing description sets forth numerous specific details such as examples of specific systems, components, methods and so forth, in order to provide a good understanding of several implementations. It will be apparent to one skilled in the art, however, that at least some implementations may be practiced without these specific details. In other instances, well-known components or methods are not described in detail or are presented in simple block diagram format in order to avoid unnecessarily obscuring the present implementations. Thus, the specific details set forth above are merely exemplary. Particular implementations may vary from these exemplary details and still be contemplated to be within the scope of the present implementations.

Related elements in the examples and/or embodiments described herein may be identical, similar, or dissimilar in different examples. For the sake of brevity and clarity, related elements may not be redundantly explained. Instead, the use of a same, similar, and/or related element names and/or reference characters may cue the reader that an element with a given name and/or associated reference character may be similar to another related element with the same, similar, and/or related element name and/or reference character in an example explained elsewhere herein. Elements specific to a given example may be described regarding that particular example. A person having ordinary skill in the art will understand that a given element need not be the same and/or similar to the specific portrayal of a related element in any given figure or example in order to share features of the related element.

It is to be understood that the foregoing description is intended to be illustrative and not restrictive. Many other implementations will be apparent to those of skill in the art upon reading and understanding the above description. The scope of the present implementations should, therefore, be determined with reference to the appended claims, along with the full scope of equivalents to which such claims are entitled.

The foregoing disclosure encompasses multiple distinct examples with independent utility. While these examples have been disclosed in a particular form, the specific examples disclosed and illustrated above are not to be considered in a limiting sense as numerous variations are possible. The subject matter disclosed herein includes novel and non-obvious combinations and sub-combinations of the various elements, features, functions and/or properties disclosed above both explicitly and inherently. Where the disclosure or subsequently filed claims recite "a" element, "a first" element, or any such equivalent term, the disclosure or claims is to be understood to incorporate one or more such elements, neither requiring nor excluding two or more of such elements.

As used herein "same" means sharing all features and "similar" means sharing a substantial number of features or sharing materially important features even if a substantial number of features are not shared. As used herein "may" should be interpreted in a permissive sense and should not be interpreted in an indefinite sense. Additionally, use of "is" regarding examples, elements, and/or features should be interpreted to be definite only regarding a specific example and should not be interpreted as definite regarding every example. Furthermore, references to "the disclosure" and/or "this disclosure" refer to the entirety of the writings of this document and the entirety of the accompanying illustrations, which extends to all the writings of each subsection of this document, including the Title, Background, Brief description of the Drawings, Detailed Description, Claims, Abstract, and any other document and/or resource incorporated herein by reference.

As used herein regarding a list, "and" forms a group inclusive of all the listed elements. For example, an example described as including A, B, C, and D is an example that includes A, includes B, includes C, and also includes D. As used herein regarding a list, "or" forms a list of elements, any of which may be included. For example, an example described as including A, B, C, or D is an example that includes any of the elements A, B, C, and D. Unless otherwise stated, an example including a list of alternatively-inclusive elements does not preclude other examples that include various combinations of some or all of the alternatively-inclusive elements. An example described using a list of alternatively-inclusive elements includes at least one element of the listed elements. However, an example described using a list of alternatively-inclusive elements does not preclude another example that includes all of the listed elements. And, an example described using a list of alternatively-inclusive elements does not preclude another example that includes a combination of some of the listed elements. As used herein regarding a list, "and/or" forms a list of elements inclusive alone or in any combination. For example, an example described as including A, B, C, and/or D is an example that may include: A alone; A and B; A, B and C; A, B, C, and D; and so forth. The bounds of an "and/or" list are defined by the complete set of combinations and permutations for the list.

Where multiples of a particular element are shown in a FIG., and where it is clear that the element is duplicated throughout the FIG., only one label may be provided for the element, despite multiple instances of the element being present in the FIG. Accordingly, other instances in the FIG. of the element having identical or similar structure and/or function may not have been redundantly labeled. A person having ordinary skill in the art will recognize based on the disclosure herein redundant and/or duplicated elements of the same FIG. Despite this, redundant labeling may be included where helpful in clarifying the structure of the depicted examples.

The Applicant(s) reserves the right to submit claims directed to combinations and sub-combinations of the disclosed examples that are believed to be novel and non-obvious. Examples embodied in other combinations and sub-combinations of features, functions, elements and/or properties may be claimed through amendment of those claims or presentation of new claims in the present application or in a related application. Such amended or new claims, whether they are directed to the same example or a different example and whether they are different, broader, narrower or equal in scope to the original claims, are to be considered within the subject matter of the examples described herein.

The invention claimed is:

1. A device, comprising:

a restraining band having a rectangular geometry with a horizontal length and a vertical height, wherein:

a horizontal length of the restraining band is greater than a vertical height of the restraining band;

the restraining band comprises:

a front side; and a back side;

the restraining band further comprising:

a body section, wherein:

the body section is prepared from an elastic material;

the body section further comprising:

a front side fastening section, wherein:

the front side fastening section has a horizontal length greater than a vertical height of the front side fastening section;

a back side fastening section;

wherein the front side fastening section and the back side fastening section comprise hook and loop fastening elements; and wherein the fastening section stretches at an interface of the front side and the back side;

a sheath configured to cover the body section, wherein:

the sheath is prepared from a fabric material;

the sheath is longer than the body section, wherein the sheath is comprised of:

a portion of fabric sized larger than the body section to facilitate the full horizontal stretch of the band;

one or more surface patterns formed through partial crimping to provide a visual indication of proper fitment;

an extended fabric section gathered between one or more fastening points configured for a smooth engagement during attachment; and strategically distributed excess material positioned around the ankle circumference to maintain comfort during movement.

2. The device of claim 1, further comprising:

a front side fastening section with a horizontal length at least two times greater than the horizontal length of the back side fastening section.

3. The device of claim 1, wherein the sheath is configured to be larger than the body section of the restraining band to allow the elastic material to stretch within the sheath.

4. The device of claim 1, wherein the restraining band is configured to be joined to an ankle portion of an article of clothing comprising a footed bottom.

5. The device of claim 1, wherein the restraining band is configured to be secured around an ankle portion of an article of clothing comprising a footed bottom, wherein:

the restraining band is not permanently attached to the article of clothing.

6. The device of claim 1, wherein the elastic material is selected from the group consisting of:

stretch jersey knit, cotton jersey knit, stretch cotton poplin, stretch cotton shirting, stretch cotton sateen, stretch cotton jacquard, stretch viscose jacquard, stretch silk satin, stretch silk crepe, stretch silk lining, stretch satin chiffon, stretch wool, stretch wool crepe, stretch velvet, stretch lace, stretch tulle, elastane, rubbers, plastics, neoprene, polyesters, elastomers, compression fabrics, warp knitting, or a mixture thereof.

7. The device of claim 4, wherein the sheath is:

prepared from a fabric material that matches the article of clothing, and includes a design and color that matches the article of clothing.

8. The device of claim 1, wherein:

back side fastening section has a square geometry;

the front side fastening section has a rectangular geometry; and the front side fastening section has a horizontal length at least three times greater than the horizontal length of the back side fastening section.

9. A method, comprising:

placing a child in an article of clothing, wherein:

the article of clothing comprises a footed bottom below an ankle portion;

placing a restraining band around the ankle portion of the article of clothing;

tightening the restraining band around the ankle of the child until the restraining band is both secure and comfortable for the child, wherein placing the restraining band further comprises;

positioning the band around the ankle to secure a footed bottom of the article in place;

adjusting the band to minimize material bunching in a foot area to prevent tripping; and controlling material distribution using partial crimping between variable attachment points, wherein excess sheath length above the ankle is configured for growth zones while maintaining stretch at an connection interface;

adjusting the restraining band to ensure the footed bottom of the article of clothing is secure on the child;

engaging a front side fastening section to a back side fastening section of the restraining band, wherein:

the restraining band is configured in a rectangular geometry;

the front side fastening section is located on a side of a body section of the restraining band opposite the back side fastening section;

the front side fastening section and the back side fastening section comprise hook and loop fastening elements; and a horizontal length of the restraining band is configured to fit the ankle of a child; and securing the front side fastening section and the back side fastening section via engagement of the hook an loop fastening elements.

10. The method of claim 9, wherein:

the back side fastening section is engaged at a distal end of the front side fastening section in an extended configuration.

11. The method of claim 9, wherein:

the back side fastening section is engaged at an end of the front side fastening section proximate to the body portion in a truncated configuration.

12. The method of claim 9, wherein:

restraining bands are placed at wrist portions of an article of clothing.

13. The method of claim 9, wherein:

a sheath is configured to surround the body portion of the restraining band;

wherein the sheath is further configured to:

match a fabric of the article of clothing, and provide added comfort to a user via rubber, padding or cushioning.

14. The method of claim 9, wherein:

back side fastening section has a square geometry;

the front side fastening section has a rectangular geometry; and the front side fastening section has a horizontal length at least five times greater than the horizontal length of the back side fastening section.

15. The method of claim 9, wherein:

the restraining band is configured to be attached to the article of clothing via loops, clips, buttons or thread.

16. A device, comprising:

a restraining band configured to be placed around an ankle portion of an article of clothing comprising a footed bottom;

the restraining band comprising:

a front side;

a back side;

a body portion prepared from an elastic material configured to position around an ankle to secure footed bottom of the article in place by:

positioning the band around ankle to secure a footed bottom of the article in place;

adjusting the band to minimize material bunching in a foot area to prevent tripping; and controlling material distribution using partial crimping between variable attachment points, wherein excess sheath length above the ankle creates growth zones while maintaining stretch at a connection interface;

a front side fastening section;

a back side fastening section; and a sheath configured to cover the restraining band wherein:

the sheath comprises a fabric material; and the sheath is:

longer than the body section;

partially crimped across variable attachment points; and adaptively stretches across a variety of body sections.

17. The device of claim 16, wherein:

the body portion of the restraining band is configured to:

match a fabric of the article of clothing; and match a design and color of the article of clothing.

18. The device of claim 16, wherein:

the front side fastening section and the back side fastening section comprise fastening elements selected from hook and loop fasteners, hook and eye fasteners, buttons, clips, tabs, and combinations thereof.

19. The device of claim 16, further comprising:

a sheath configured to:

to surround the body portion of the restraining band; and provide additional comfort to a user;

wherein:

the sheath comprises rubber, padding, or cushioning elements.

20. The device of claim 16, further comprising:

a sheath configured to surround the body portion of the restraining band, wherein:

the sheath is configured to not match a color or design of the article of clothing.

* * * * *